United States Patent [19]

Schnekenburger et al.

[11] 4,355,847

[45] Oct. 26, 1982

[54] APPARATUS FOR HOLDING AND DISPLAYING BRUSH BODIES

[75] Inventors: Emil Schnekenburger; Rudolf Schnekenburger, both of Zell, Fed. Rep. of Germany

[73] Assignee: Coronet Werke Heinrich Schlerf GmbH, Wald-Michelbach, Fed. Rep. of Germany

[21] Appl. No.: 207,869

[22] Filed: Nov. 18, 1980

Related U.S. Application Data

[63] Continuation of Ser. No. 83,062, Oct. 9, 1979, abandoned, which is a continuation of Ser. No. 877,250, Feb. 13, 1978, abandoned.

[30] Foreign Application Priority Data

Oct. 26, 1977 [DE] Fed. Rep. of Germany ..... 2747855

[51] Int. Cl.[3] ..... B25B 11/02; A46D 3/00

[52] U.S. Cl. ..... 300/11

[58] Field of Search ..... 300/10, 11; 408/3

[56] References Cited

U.S. PATENT DOCUMENTS

| | | | |
|---|---|---|---|
| 3,704,915 | 12/1972 | Schofield | 300/11 X |
| 4,029,427 | 6/1977 | Cloup | 408/3 |
| 4,053,250 | 10/1977 | Jestice et al. | 408/3 |

FOREIGN PATENT DOCUMENTS

| | | | |
|---|---|---|---|
| 1072956 | 1/1960 | Fed. Rep. of Germany | 300/11 |

*Primary Examiner*—Howard N. Goldberg
*Attorney, Agent, or Firm*—Edwin E. Greigg

[57] ABSTRACT

A switching device for the displacement of the brush body holders in brush manufacturing machines during the drilling and stuffing operations in the production of brushes. Necessary displacements can be accomplished simply and accurately for any shapes of brush bodies without requiring any machine modification or readjusting by utilizing a programmable logic control system and hydraulic linear force amplifiers.

9 Claims, 3 Drawing Figures

APPARATUS FOR HOLDING AND DISPLAYING BRUSH BODIES

This is a continuation of application Ser. No. 083,062 filed Oct. 9, 1979, now abandoned, which is a continuation of Ser. No. 877,250 filed Feb. 13, 1978, now abandoned.

BACKGROUND OF THE INVENTION

The switching apparatus for the displacement of brush body holders comprises in its usual form a holding device for the brush holders to which are normally fastened the brush bodies, as well as shifting devices which move either the brush holders themselves, or their supporting devices in such a manner, that it becomes possible, in a comparatively rapid working process, to drill the holes in the brush body which receive the brush bundles, and/or to fill these with the brush bundles.

At least for the shifting of the brush body holders and therefore, the attached brushes, in one direction, but preferably for the whole complex shifting and swinging movement of the brush body holders, so called linear amplifiers are used, i.e., such moving systems which include a primary moving element, as for instance, a stepping motor which responds to electrically produced control signals, and furthermore, an amplifying part controlled by the above-mentioned primary moving element, which provides the smallest path increments with utmost accuracy and considerable power. These hydraulic linear amplifiers provide immediate movement of the elements of the brush manufacturing machine and do not need any intermediate and normally complicated mechanical transmissions, nor any transmitting chains such as races, cranks, cardan shafts, or the like. The control of the linear amplifiers is accomplished by means of logical switching elements chosen in accordance with the brush body type to be processed, for instance, microprocessors, which either have their own memory, or at least can be correspondingly controlled by external memories, and which are "per se" sufficiently known.

DESCRIPTION OF THE PRIOR ART

The invention includes a switching apparatus in accordance with the kind needed. There are already known many switching apparatuses for the displacement of brush body holders on brush manufacturing machines. Some of these can be found in the following publications, that represent several alternatives, namely: German Patent publications Nos. DT-PS 1 186 027, DT-PS 1 072 956, DT-AS 1 782 820, DT-AS 1 199 227, DT-OS 24 47 442; and DT-OS 25 49 015.

Since the movements carried out by brush holders during the drilling and stuffing of brushes, brooms, etc. are comparatively very complicated, and because, on the other hand, the working procedure should not be a very long one, there have been used until today complicated controlling and moving components serving to displace the brush body holders. Normally, precoded information for each kind of brush body to be manufactured is placed on perforated tapelike information records. This information is then electrically scanned by means of feelers-tracers which electronically control the required displacements, with rapidly moving sets of mechanical gearing elements; pinions, ratchets, etc., helping to shift the brush body holders according to the information sequences, each time by one partial length of the path. Since the brush body holders have to be displaced and swung at least in the X-Y coordinates plane, i.e., in two directions, and that in some occasions there is needed also an elevation adjustment, one can easily understand the considerable amount of complicated mechanical transmission members which often have to execute a very sophisticated series of carefully coordinated movements. Thus, for instance, in the recently published German Pat. No. DT-AS 1 782 820, use is made of the "drop-cut-off" mechanisms, which are controlled by means of a perforated controlling tape scanned by at least one tracer drawn over the controlling tape. Transmission of the controlling impulses occasioned by the controlling cams ensues then towards the drop-cut-off mechanisms through the intermediary of Bowden controls, or immediately to the corresponding ratchets.

In the switching apparatus made known by the German publication No. DT-OS 2 447 442 and serving to create a step-by-step movement of a movable brush holder, there are catches which engage and thereby rotate a toothed wheel in one or in the opposite direction in order to generate distinctive rotating movements. These rotating movements are imparted to the appropriate transmission mechanisms to induce corresponding movements of the brush holders. In particular, this toothed wheel features on its opposite sides two clics, which under the influence of a shaped piece, engage alternately in the toothed wheel. The actual pace length is determined by the position of a block movable in a swinging crank by means of a programmed combination of pneumatic cylinders. A centrally located shaft actuates the mutually coordinated movements of the separate components by means of eccentric cams, rings, chain drives, etc.

Although in this known switching apparatus there are already provided pneumatic cylinders controlled in accordance with a program, thus providing devices which carry out their movements under the influence of the external forces and according to a programmed control, the intricacy of the entire switching apparatus is only increased by the presence of the pneumatic cylinders. The actual program execution is here too obtained by scanning of a correspondingly coded perforated strip encroached by scanning bolts or pins.

The previously known complicated construction of brush manufacturing machines is made complete by the necessity of providing these machines with the so-called compensating devices. So as it is known, the brush body must be shifted or transferred to and from the normally immovable drilling and stuffing devices, at least about a horizontal, as well as about a vertical axis, in order to permit the hole drilling and the brush bundles stuffing in the brush body. In order to drill holes at the extremities of the brush body, the latter has to be moved with respect to the tool, so that these holes have the same depth as the holes in the middle part of the brush body. Such a movement is produced by means of the above-mentioned compensating device, which also could be designated as the elevation adjustment device.

It is already known how to carry out the swinging movement of the brush body, as above mentioned, by means of a swinging rods mechanism, whose movements can take place about a vertical and a horizontal axes, and to carry out the compensating movement by means of the cam discs. But it is also possible, as it can be seen from the German patent publication No. DT-PS 1 018 388, to derive this compensating movement from the movement of the swinging rods through the intermediary of the elevation adjustment device, i.e., by correlating the translation by means of the elevation adjusting device with the general movement process taking place in the coordinates plane X—Y by translation or by tilting movements.

Accurate machining is possible only when the type of the brush body to be worked on is known and predetermined; the working on differently shaped and dimensioned brush bodies, as for example, brooms, etc., will necessitate a complicated readjustment work.

Finally, the German patent publication No. DT-AS 1 216 238 provides a weight compensation appliance, working with a pressure fluid and used with brush body drilling and stuffing machines. The brush body holders are disposed vertically under each other on a horizontally movable carrier. There are provided connecting rods which are brought together and catch an extremity of a centrally supported lever. The other extremity of this lever executes the usual swinging movement by means of face cams, that is, the swinging of the brush bodies in a substantially vertical plane. The centrally supported and movable lever is acted upon by a weight compensating apparatus which works with a pressure fluid and includes a piston and a cylinder. One end of the lever is supported in a stationary way. The cylinder is filled with the pressure fluid through a conduit which communicates with a pressure fluid tank where the pressure can be regulated by means of a pressure scale. When the swinging movement of the lever, obtained by means of the pace cam, exerts a pressure on the piston of the compensating apparatus, the pressure in the pressure fluid tank increases. During movement of the lever in the opposite direction the pressure fluid flows back from the tank and helps in this manner the rising motion of the lever. It can be understood that this pneumatically or hydraulically working cylinder merely provides a damping, prevents derailment and serves no controlling purpose.

SUMMARY OF THE PRESENT INVENTION

The switching apparatus in accordance with the present invention provides in addition to its principle function, the advantage that the linear motion source components which produce the translatory movement of the brush body holders, and which normally work with the hydraulic power assistance, act upon the movable parts, for instance, a common lever which connects all brush body holders. This causes a considerable increase in the productivity of brush manufacturing machines because of the low inertia of the whole motion system. After carrying out the working operations on the brush bodies (drilling and stuffing), the actual displacing movements can be carried out extremely rapidly and, moreover, with high accuracy and without any overswinging. There are no further transmission elements present, such a gears, racks, cranks, cardan shafts, etc., so that all coincidental problems like the stiffness of the transmission paths, backlash, safety difficulties, etc. are avoided.

The hydraulic linear force amplifiers, such as used in the present invention are "per se" well known and are provided with a primary motion component which can be controlled by means of electrical controlling signals. Normally, step motors whose motion can be controlled by means of discrete controlling impulses in an extremely accurate manner can be utilized. It is therefore possible, when using the hydraulic linear force amplifiers, to control each directional movement independently from the others and in a highly accurate manner by supplying correspondingly predetermined electrical control signals.

The controlling of all linear force amplifiers used in the displacement of the brush body holders can be obtained by means of a unique programmable logic control appliance, which can be a microprocessor. Such logic control appliances can be made by using microprocessors externally connected, or by means for externally feeding information prescribing a determined programmed procedure, consequently, the previously known complicated perforated strip controlling systems can be replaced by simply feeding the information data by a typing device on the front panel of the logic control appliance.

Alternatively, it is also possible to incorporate with the logic control system, or with the microprocessors, a correspondingly preprogrammed memory, or the so-called ROM (read only memory), or the so-called PROM (programmable read only memory), whose information banks have already been preprogrammed for the determined shapes of the brush bodies. It is therefore possible to retool the entire brush manufacturing machine, so as to correspond to the different models of the brush bodies, by a simple replacement of these PROMs or ROMs. The frequency of the controlling signals can be considerably increased, since the driving speed of the hydraulic linear force amplifiers accurately corresponds to the frequency of the controlling impulses, or the rotations of the controlled step motors, and can, therefore, be regulated in an infinitely variable way.

A particular advantage gained by the use of linear force amplifiers is the capability to regulate the acceleration or retardation, in order to coordinate the driving conditions with the inertia masses to be set in motion and with the machine's characteristics and to thus achieve the optimal running condition. The invention succeeds in a revolutionary manner to replace the previously known, mechanically expensive, uneconomical and comparatively exposed to disturbances switching apparatuses in brush manufacturing machines.

The invention considerably simplifies the construction and the working process and significantly lowers the noise level, because the direct contact of the electrohydraulical locating members with the work pieces have eliminated the need for long transmission chains. It also simplifies, in particular, the controlling and scanning process which was previously necessary for the motion development. Furthermore, the inevitable wear of the controlling strips used in mechanical scanning is thus avoided.

BRIEF DESCRIPTION OF THE DRAWINGS

Practical examples of the invention are represented in the accompanying drawings. They will be separately explained in detail in the following descriptions.

DETAILED DESCRIPTION OF THE PRESENT INVENTION

It must be understood that the drawings described in the following detailed description represent only one preferred arrangement, and are not exclusively definitive of the scope and spirit of the present invention. It should be understood that the brush body holders can also be supported vertically and then translated and swung in the desired direction. It is only necessary that the supports are conceived in such a way that the translatory movements and/or the swinging motions in the X or Y direction, as well as a compensating level adjustment are also possible. The level adjustment as shown in the arrangement of FIG. 1, demonstrates a level compensation system which provides displacements essentially in a vertical plane.

Figure 1:
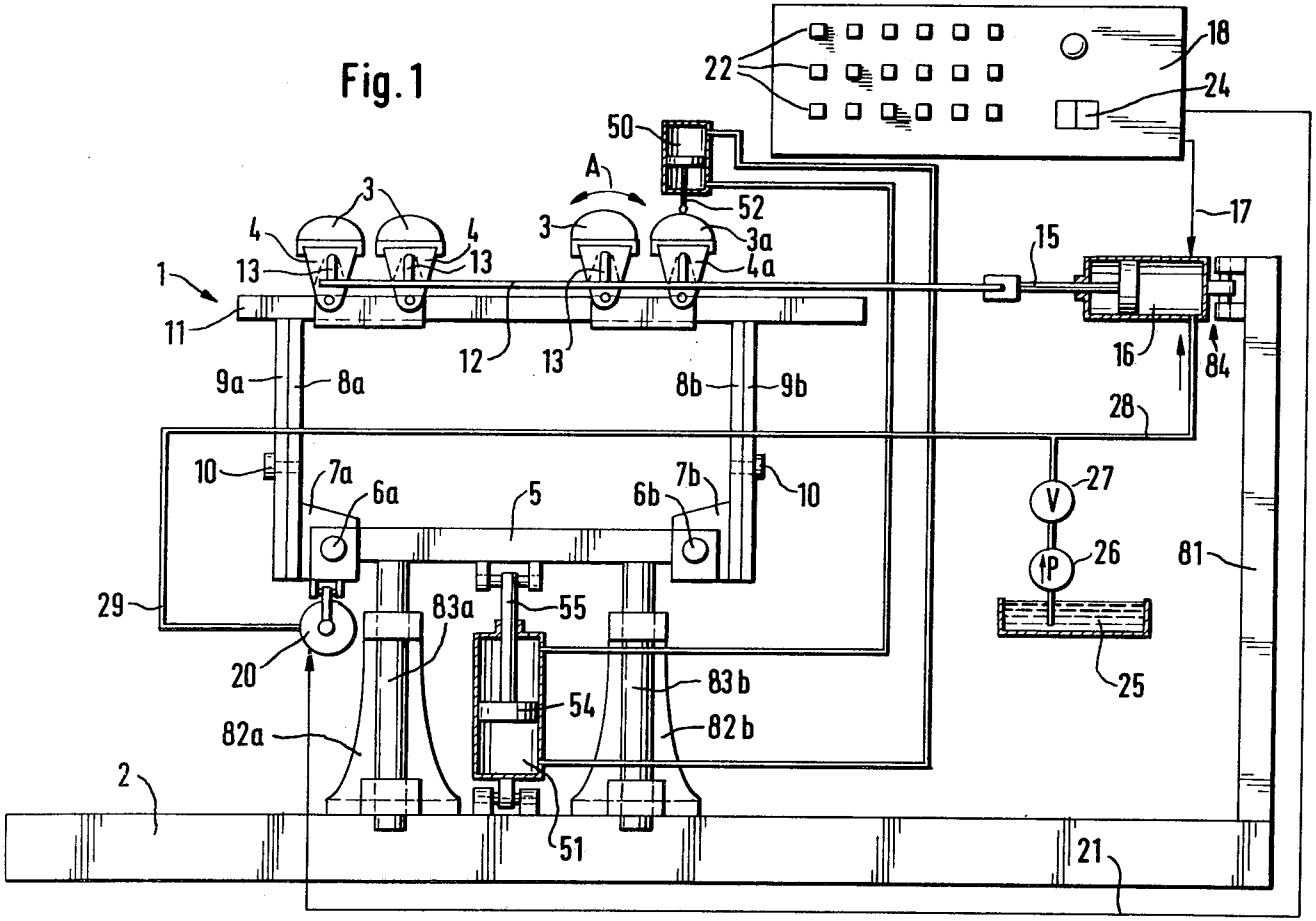
FIG. 1 represents a schematic representation of a possible and preferred embodiment for the support and displacement of the brush body holders in a side view.

In FIG. 1, the brush manufacturing machine 1 includes a machine frame 2 with a horizontal but vertically adjustable jib 5. From the lower machine frame 2 can rise still further vertical posts or beams, which serve to support tooling devices above the brush bodies 3. Since these tooling devices, their support, their functioning and their positioning with respect to the machine frame 2 in the present invention are not of paramount importance, the matter will not be dealt with here. The tooling support arrangement can be either stationary or adjustable. It is essential, however, that the brush body holders 4 are supported within the machine frame 2 in such a manner that the brush bodies 3 can be displaced substantially anywhere throughout the machine frame 2, that is, swinging movements, translating movements, and combined translating and swinging movements, such as are necessary for the brush manufacturing processing, as well as the movements in the height direction, i.e., in the example of FIG. 1, in the upward and downward directions.

To the machine frame there are fastened vertical bearings 82*a* and 82*b*, in which slide columns 83*a* and 83*b*, which support at least one horizontal transverse beam 5. On each end of the transverse beam 5 is a horizontal bar, 6*a* and 6*b*, positioned perpendicular to the transverse beam 5 which serve as sliding supports for the sleds 7*a* and 7*b*. These sleds 7*a* and 7*b* are translatable in a horizontal plane perpendicular to the drawing's plane. Securely mounted to the sleds 7*a* and 7*b* are the supporting plates 8*a* and 8*b* respectively. These supporting plates hold the exterior bearing plates 9*a* and 9*b* by means of the swivel studs 10 in such a manner that, if necessary, a swinging movement can be carried out in the same plane where there is possible a translation by means of the sleds 7*a* and 7*b*. Normally, during the swinging motion in this plane perpendicular to the drawing's plane, only one of the above-mentioned displacement possibilities is used.

The exterior bearing plates 9*a* and 9*b* are secured at one end to an upper transverse beam 11 which is adapted to support the brush body holders 4. The brush body holders 4, pivotally connected at the beam 11, are connected together by a common connecting lever 12 via the intermediate lever 13 so that a lateral displacement of the lever 12 produces a swinging movement of the brush body holders 4 in the direction of the double arrow A. This connecting and controlling lever 12 is fastened to the piston rod 15 of a hydraulic working cylinder 16 which is moveably connected by a hinge assembly 84 to a vertical post 81 of the machine frame 2 and which further comprises the above-mentioned hydraulic linear force amplifier; its particular construction will be discussed more at length in the detailed description of FIG. 2. The linear force amplifier essentially controls the translatory movement of piston rod 15 and therefore the controlling lever 12, by responding to a series of control impulses communicated to it through a controlling lead 17 from a centrally located electronic logic system (microprocessor provided in a control box or housing 18 mounted on the vertical post 81 near the linear force amplifier (15, 16). This results in a swinging movement of the brush body holders 4 and, therefore, of the thereto fastened brush bodies 3, as corresponding to the arrow when an appropriate control impulse is applied to the linear force amplifier.

A swinging motion in the plane perpendicular to the drawing's plane about the bearing stud 10, or a translatory movement in this same plane is obtained by means of a second hydraulic linear force amplifier 20 which as shown in FIG. 1, is fastened by its piston rod to the sled 7*a*, and is stationary with respect to this machine frame 2. It should be understood that this amplifier 20 can also be operatively connected to the swingbar bearing plates 9*a* (9*b*). Control impulses are received by the second linear force amplifier 20 through the connecting lead 21, from the central logic system, which, as it has been mentioned before, can be a programmable microprocessor.

The microprocessors can be adapted for any desired applications in a manner well known in the art and their construction will not be discussed at length any more. It should be understood, however, that, as it has been already mentioned, the repetitive operation of the linear force amplifiers can be predetermined in a most accurate way by means of corresponding instructions introduced by the keyboard 22, or by inserting corresponding memory inputs in the appropriate receiving opening in the front panel of box 18, for example, the PROMs or ROMs. In FIG. 1, such a memory is designated by the reference number 24.

In order to be complete, the brush manufacturing machine of FIG. 1 includes also a hydraulic system comprising a pressure fluid sump 25, a pump 26 for the hydraulic pressure fluid, a return valve 27 and the two distribution conduits 28 and 29, which supply pressure fluid to the hydraulic linear amplifiers. Fluid return conduits can be also included, if desired.

Figure 2:
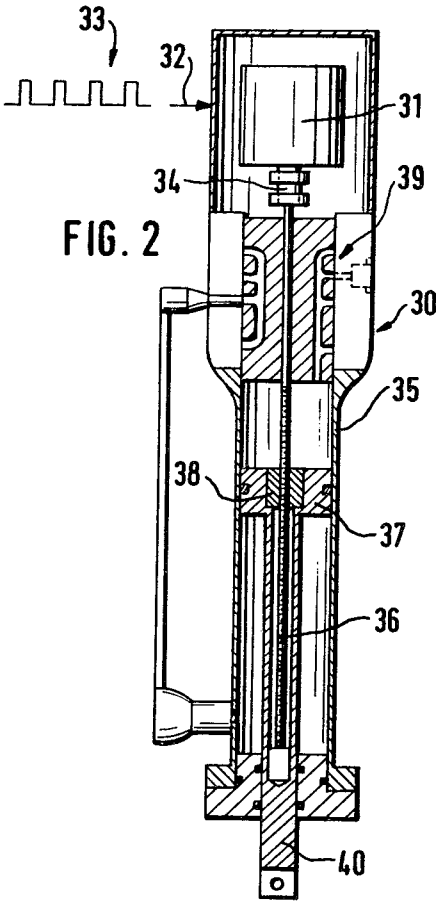
FIG. 2 is an elevational cross section of a "per se" known hydraulic linear force amplifier preferably used for the displacement system of FIG. 1.

In FIG. 2, a hydraulic linear amplifier as is already well known, is shown. Therefore, its construction and function have to be described only in an abbreviated manner.

Each linear amplifier 30 comprises a closed regulation circuit or closed control loop, wherein the regulating valve, the position return element and the positioning cylinder are integrated in one structural unit. There is provided an electrical controlling motor, for instance, a stepping motor 31, which can receive through the entrance 32 a series of electrical controlling impulses 13. The stepping motor 31 (here can be used a tachymetrically regulated d.c. motor) is connected by an axial, elastic, and therefore flexible, though torsion-proof coupling 34, to one end of a driving spindle (trapezoidal spindle 36) within the cylinder 35. The driving spindle threadably engages a spindle nut 38 secured within the piston 37. The other end of the trapezoidal spindle is received in an axial bore in the piston rod. Through the rotation of the controlling motor 31 the spindle is screwed into the spindle nut and produces therefore, an axial displacement of the hydraulic, regulating valve 39 usually a square section controlling slide. Displacement of the slide provides an oil stream which influences the piston 37 in the manner that the working piston is displaced, and that the trapezoidal spindle 36 connected thereto is influenced in such a way, that the regulating valve 39, namely the controlling slide, closes again.

Consequently, the controlled rotation of the stepping motor 31 produces a displacement of the piston rod 40 with respect to the working cylinder 35. This piston rod 40 is connected immediately to the elements to be moved of the brush manufacturing machine shown in FIG. 1.

It has already been mentioned that in such brush manufacturing machines there exists a necessity for a shifting movement described further on as the level adjustment, so that the bore holes are placed always vertically and to the same depth, but can be disposed over the general shape of the brush body.

This invention solves the problem which previously required application of extremely complicated solutions by providing a controlling device 50 (see FIG. 1), as well as a thereby controlled working cylinder 51.

It is essential that the controlling device 50 be provided with a scanning pin or scanning roller 52 which remains in permanent contact with a brush body 30*a*. The brush body 3*a*, like all other brush bodies 3 which have to be worked on, is fastened on a brush body holder 4*a*, identical with the other brush body holders 4 and identical with the shifted brush body holders 4*a*.

Anyway, this brush body 3*a*, undergoes no working procedure, and serves only as a control for the scanning pin 52. The controlling device 50 and the working cylinder 51 form a balanced system. This balanced state is destroyed when the scanning pin 52 departs from its initial position upwards or downwards. In that case the controlling device 50 produces a corresponding response in the working cylinder 51 in such a way that it axially displaces piston 54, and thereby, the piston rod 55 that pushes the transverse beam 5 upwards or downwards so that the scanning pin again returns to its initial position. This, as expressed in other words, signifies only that such level adjustment device permits the brush body holders 4 to travel over the entire table supporting the brush body holders (which could be also the so-called cross table) in a manner which corresponds to the shape of the brush body type which is being worked on.

This measure alleviates and simplifies the task of the level adjustment in brush manufacturing machines, since it is not necessary to express the particular shape of the brush body in a correspondingly coded form in order to control the controlling devices, or to deduct the level adjustment or the compensating movements from the other displacements of the brush body holders.

Figure 3:
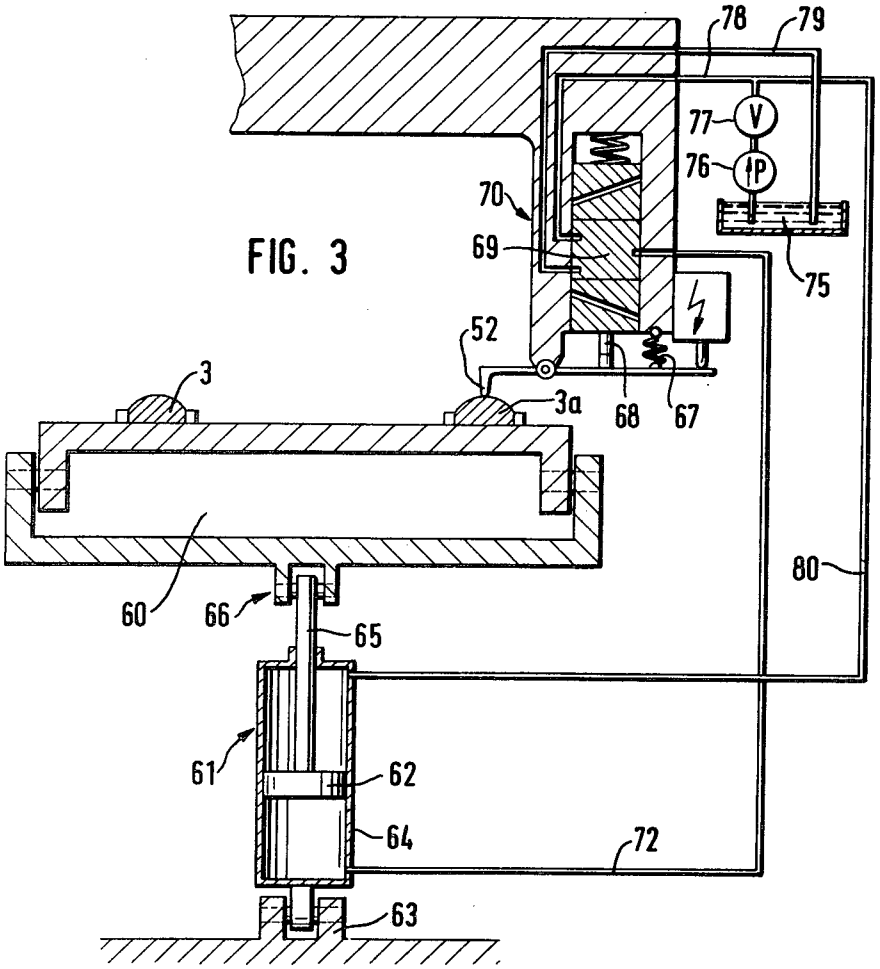
FIG. 3 is a partial schematic diagram of an advantageous example of the invention of FIG. 1 provided with a level adjustment or compensating device, which also works by means of the hydraulic force amplification.

This particular mechanism already considered as a part of the invention, permits highly accurate positioning of the brush body holders' bearing table. Since the positioning is only dependent on the actual shape of the brush body, the device is considerably less expensive than one using coded control. From the representation of FIG. 3 can be seen the construction and the operating mode of the level adjustment device. It will be understood that the representation of FIG. 3 shows the essential parts of the level adjustment device in schematic form, and that it is not to be understood as limiting. The brush body bearing table 60 (over the not shown brush body holders) can be moved upwards and downwards (not shown) and namely under the influence of a pneumatic or hydraulic working cylinder 61, which comprises a piston 62 and a cylinder part 64 supported by the machine frame 63. The working piston is fastened to one end of a piston rod 65, and the other end of the rod 65 is pivotally connected at 66 to the table 60.

A plurality of brush bodies 3 to be machined (only one of which is shown in FIG. 3) are mounted on the table 60. In addition, a brush body 3*a* is mounted thereon to provide a control surface for the scanning pin 52 which abuts the brush body 3*a* and which is held by a pretensioned spring 67. The scanning pin is connected by means of a connecting rod 68 to a slide member 69 of a hydraulic regulating valve 70 (shown in its zero-position).

The position of the slide member 69 controls the pressure of the pressure fluid arriving through the hydraulic conduits 80 and 72 to the working cylinder 61 in such a way that the working cylinder 61 holds the table 60 in the predetermined position. The pressure fluid is pumped from the sump 75 with aid of a pump 76 and a return valve 77, through the conduit 78 to the regulating device valve 70; a return conduit is designated by 79. The pressure fluid arrives from the pump 76 and through the conduit 80 to the piston rod side of the working cylinder 61.

When the scanning pin 52 is moved from its initial position, the position of the controlling slide 69 in the regulating valve 70 is modified, and thereby causes the pressure fluid to flow to the working cylinder 61. The pressure fluid displaces the piston rod 62 so as to adjust the height of the brush bodies on the table 60 until the surface of brush body 3*a* engages the pin 52 and returns it to its original position.

The present regulation is a case of a hydraulic response regulation, which ensures a highly accurate positioning. Since the hydraulic response regulation systems, which works with edge control feeler valves, are well known, we need not described at more length the particular construction of the regulating valve 70 and of the multitude of existing pressure conduits, controlling edges, etc.

The explained level adjustment device assures the accurately positioned level adjustment of the table corresponding to movements of the pin 52 as it follows the contour of the surface of the brush body 3*a* and in conjunction with the other movements made by the brush body holders during the working on the brush bodies.

It is apparent that although we have described but a single embodiment of the present invention, many changes and modifications can be made therein without departing from the spirit of the invention as expressed by the appended claims.

We claim:

1. A spatial positioning and index mechanism for brush body holders in brush manufacturing machines which perform drilling and stuffing operations comprising, in combination:

a frame;

at least one brush body holder, which is movably disposed on said frame for displacement in various predetermined directions and distances;

at least first and second hydraulic linear force amplifiers for displacing said at least one brush body holder in two perpendicular directions and for hydraulically arresting the at least one brush body holder during drilling and stuffing operations, each hydraulic linear force amplifier including a hydraulic piston-cylinder assembly connected directly directly to said at least one brush body holder and said frame for displacing said at least one brush body holder, said piston-cylinder assembly having a pressurized fluid chamber, a hydraulic regulating valve, means for connecting said pressurized fluid chamber of said piston-cylinder assembly with said hydraulic regulating valve, and a controlling means having a coupling means connected to said hydraulic regulating valve, said controlling means being responsive to electrical control signals for determining the displacement of said piston in said piston-cylinder assembly, said means for connecting said hydraulic control valve and said hydraulic piston-cylinder assembly being arranged in combination with said controlling means, said hydraulic regulating valve and said hydraulic piston-cylinder assembly to form a closed control loop in which displacement of said hydraulic linear force amplifier are determined by said controlling means; and a programmable electronic logic control system having a non-mechanical memory for supplying to the controlling means of the at least two hydraulic linear force amplifiers respective electrical control signals corresponding to stored data in said memory representing predetermined brush body displacements.

2. The mechanism according to claim 1, wherein said hydraulic linear force amplifiers comprise respective receiving chambers for pressurized fluid and wherein the mechanism further comprises a pressurized fluid source and conduit means for supplying pressurized fluid from said source to said receiving chambers.

3. The mechanism according to claim 1, which further comprises a control bar connected to said at least one brush body holder, and wherein said first hydraulic linear force amplifier has an output shaft which is pivotally connected to said control bar.

4. The mechanism according to claim 3, wherein said frame comprises:

a table having an upper surface and a bottom, with its upper surface adapted to pivotally secure a plurality of said brush body holders thereon;

at least two first support legs;

at least two second support legs, each said second leg disposed adjacent to, and rotatably secured to a corresponding first support leg by a pivot pin, said second legs being secured at one end to the bottom of said table;

at least two sled members corresponding in number to the number of said first support legs, and secured to the lower end of each first support leg; and at least two sled rails disposed below but parallel to said table, slidably engaging said sled members so that said sled members can be slidably displaced along the length of said sled rails;

wherein the second hydraulic linear force amplifier is secured to said frame so as to alternately slide the sled members along the sled rails and pivot said second support legs.

5. The mechanism according to claim 1, wherein said programmable logic control system comprises a housing, at least one microprocessor secured within said housing, and a key board externally mounted on said housing to feed data corresponding with the kind of brush bodies to be worked on into said system for the purpose of executing the corresponding displacements.

6. The mechanism in accordance with claim 1 wherein the programmable logic control system includes preprogrammed memories (PROM, ROM), containing data chosen in conformity with the type and shape of the brush bodies to be worked on.

7. The mechanism in accordance with claim 1, wherein said frame comprises:

a table having an upper surface adapted to pivotally secure a plurality of said brush body holders thereon; and a level adjustment device for controlling the height of said table comprising a sensing device amounted above one of said brush body holders, including a scanning pin which contacts a top surface of a brush body held in that brush body holder during displacements of said brush body holders, and a hydraulic cylinder mounted on said frame and coupled to said table, which displaces said table in response to the output of said sensing device as it detects the displacements of the brush body.

8. The mechanism according to claim 7, wherein said sensing device includes a regulating valve with a controlling slide which is fastened to said scanning pin so that displacements of said scanning pin shift and said controlling slide within said valve and thereby adjusts a fluid pressure communicating with said hydraulic cylinder until said scanning pin is returned to its original position.

9. The mechanism according to claim 1, wherein each hydraulic linear force amplifier includes a stepping motor which constitutes said controlling means and receives said control signals from said logic control system, a spindle axially aligned and coupled with the shaft of said stepping motor, a spindle nut which is disposed in said piston to threadably engage said spindle, and a slide of said hydraulic regulating valve which is axially maintained in a permanent position with respect to said spindle in such a manner that this controlling slide, by means of a corresponding controlling action of the pressure fluid on the piston, is returned to its zero-position.

* * * * *